US005923937A

United States Patent [19]

Thompson et al.

[11] Patent Number: 5,923,937

[45] Date of Patent: Jul. 13, 1999

[54] ELECTROSTATOGRAPHIC APPARATUS AND METHOD USING A TRANSFER MEMBER THAT IS SUPPORTED TO PREVENT DISTORTION

[75] Inventors: David L. Thompson, W. Henrietta; Thomas N. Tombs, Brockport, both of N.Y.

[73] Assignee: Eastman Kodak Company, Rochester, N.Y.

[21] Appl. No.: 09/103,007

[22] Filed: Jun. 23, 1998

[51] Int. Cl.[6] ..... G03G 15/01

[52] U.S. Cl. ..... 399/302; 399/308

[58] Field of Search ..... 399/313, 101, 399/297, 298, 299, 302, 303, 308, 66; 430/126

[56] References Cited

U.S. PATENT DOCUMENTS

| | | | |
|---|---|---|---|
| 4,078,929 | 3/1978 | Gundlach | 430/42 |
| 4,712,906 | 12/1987 | Bothner et al. | 399/303 |
| 5,084,735 | 1/1992 | Rimai et al. | 399/302 |
| 5,187,526 | 2/1993 | Zaretsky | 399/302 |
| 5,370,961 | 12/1994 | Zaretsky et al. | 430/126 |
| 5,710,964 | 1/1998 | Tombs et al. | 399/302 X |
| 5,732,310 | 3/1998 | Hiroshima et al. | 399/101 |
| 5,745,830 | 4/1998 | Fujiwara et al. | 399/308 |
| 5,809,387 | 9/1998 | Takeuchi et al. | 399/302 |

FOREIGN PATENT DOCUMENTS

WO 98/04961 2/1998 WIPO .

OTHER PUBLICATIONS

US Patent Application 08/900,696.
US Patent Application 08/572,559.
US Patent Application 08/846,056.
Miskinis (IS&T Sixth International Congress on Advances on in Non–Impact Printing Technologies, pp. 101–110 published in 1990).

*Primary Examiner*—Arthur T. Grimley
*Assistant Examiner*—Hoan Tran
*Attorney, Agent, or Firm*—Norman Rushefsky

[57] ABSTRACT

In a reproduction method and apparatus, a marking particle image is formed on an image-supporting member. A moving web supports a receiver member to advance the receiver member into a nip defined between the image-supporting member and a transfer roller. The web is in the nip during transfer so that the receiver member is between the web and the image-supporting member. An electrical transfer field is established in the nip for electrostatically transferring the marking particle image to the receiver member. A support roller presses against a portion of a roller surface of the transfer roller that does not form the nip to reduce bending of a portion of the rolling surface of the transfer roller that is associated with the nip.

22 Claims, 6 Drawing Sheets

ELECTROSTATOGRAPHIC APPARATUS AND METHOD USING A TRANSFER MEMBER THAT IS SUPPORTED TO PREVENT DISTORTION

CROSS REFERENCE TO RELATED APPLICATIONS

This application is related to U.S. application Ser. No. 08/900,696, filed on Jul. 25, 1997, in the names of Tombs et al and entitled "Method and Apparatus Using an Endless Web for Facilitating Transfer of a Marking Particle Image From An Intermediate Image Transfer Member to a Receiver Sheet" and to U.S. application Ser. No. 08/935,425, filed on Sep. 23, 1997, in the names of May et al and entitled "Method and Apparatus for Sensing and Accommodating Different Thickness Paper Stocks in an Electrostatographic Machine".

FIELD OF THE INVENTION

The present invention is directed to an electrostatographic apparatus and method for transferring toner or marking particle images using a transfer member that is supported to prevent distortion.

BACKGROUND OF THE INVENTION

In modern high speed, high quality electrostatographic reproduction apparatus (copier/duplicators or printers), a latent image charge pattern is formed on a uniformly charged dielectric support member. Pigmented marking particles are attracted to the latent image charge pattern to develop such image on the support member. The dielectric support member is then brought into contact with a receiver member, such as paper, and an electric field applied to transfer the marking particle developed image to the receiver member from the dielectric support. After transfer, the receiver member bearing the transferred image is transported away from the dielectric support member and the image is fixed to the receiver member by heat and/or pressure to form a permanent reproduction thereon. Preferred support members may comprise a photoconductor or an electrographic recording member, both of which are broadly referred to herein as a primary image-forming member.

The prior art has recognized certain advantages to not providing direct contact between the receiver member and the primary image member. Thus, the use of intermediates in both single color image formation and multicolor image formation is suggested in the prior art. For example, FIG. 8 of U.S. Pat. No. 4,712,906 shows a series of single color images being formed on a primary image forming member. The single color images are transferred in registration to an intermediate roller to create a multicolor image on the surface of the roller. A multicolor image is then transferred in a single step to a receiver sheet at a position remote from the primary image forming member. This system is particularly advantageous in forming multicolor marking particles images, because the receiver sheet does not have to be attached to a roller for recirculation and can be fed along a substantially straight path. It can also be used with single color marking particles image formation for a number of other reasons including facilitating duplex and preventing contact between a primary image-forming member and a receiver sheet which may contaminate the image member with paper fibers and the like.

The use of a non-compliant intermediate transfer member in electrophotographic machines to transfer toner from an imaging member to a print media (e.g., paper) is well known. Both Rimai et al, U.S. Pat. No. 5,084,735 (1992) and Zaretsky and Gomes, U.S. Pat. No. 5,370,961 (1994) have shown that by using an intermediate transfer member (ITM) composed of a thick compliant layer with a relatively thin stiff overcoat improves the transfer efficiency of toner compared to non-compliant intermediates. Zaretsky, U.S. Pat. No. 5,187,526 (1993) points out that transfer can be improved by separately specifying the resistivity of the ITM and the second transfer roller, which forms a nip for transfer to paper. The difficulty encountered by the aforementioned techniques of utilizing intermediate transfer rollers is the limitation imposed by air breakdown (ionization) in the vicinity of the nip in which the toner is transferred from the ITM to the print media. Air breakdown degrades the transfer efficiency and image quality of toner images, especially multicolor images, by altering the quantity of charge on the toner particles. In practice, these difficulties are amplified because the rollers backing the paper are typically composed of materials that are sensitive to fluctuations in temperature and relative humidity. Furthermore, the need to reliably detack paper from the ITM is complicated and imparts further constraints on the design of the ITM that increase the cost of the system and degrades image quality. Difficulties are especially encountered when a wide range of print media are used, e.g. card stock, clay coated papers, resin coated paper, transparency, and conventional paper that has been dried by exposure to low humidity or sent through a fusing device.

In order to overcome many of these problems, there is suggested in U.S. application Ser. No. 08/900,696 the use of an insulating transfer endless web in conjunction with a compliant intermediate member. The endless web is provided to support the receiver sheet in a transfer nip with the ITM. An electrical field of a bias suited for transfer is established in the nip for electrostatically transferring a marking particle image on the ITM to a receiver sheet brought into intimate contact with the ITM in the nip. In the various embodiments described in the above-referenced application, several feature a transfer roller that is urged against the underside of the endless belt to provide pressure in the transfer nip. The transfer roller is also electrically biased to establish an electrical field for urging marking particles on the ITM to the receiver sheet in the nip. In analyzing the nature of transfer from the ITM to the receiver sheet, it appears that transfer can be improved by providing a transfer roller that is relatively small in diameter so that the wrap of the endless web on the ITM is larger than the transfer roller/ITM nip length. Additionally, it is desirable that the transfer roller apply adequate pressure to insure intimate contact of the receiver sheet with the marking particle image on the ITM.

In order to insure that the above conditions suited for successful transfer are provided, the inventors have found that when a support roller is engaged against a small diameter transfer roller, the support roller prevents the transfer roller from bending and thus minimizes distortion in the uniformity of the nip along the length of the transfer roller and provides for a more uniform nip pressure. Improved uniformity in the nip provides for more uniformity in the electrical transfer field and thereby provides for improved conditions for image transfer.

SUMMARY OF THE INVENTION

It is therefore an object of the invention to provide for the improved transfer of marking particles from an image-bearing member to a receiver sheet. This and other objects and advantages noted herein are realized by a reproduction apparatus and method wherein an image-bearing member supports a marking particle image that is to be transferred to a receiver member. The receiver member is supported by a moving web. A transfer roller urges the web into engagement with the image-bearing member to define a transfer nip with the image-bearing member.

A support roller engages the transfer roller to reduce distortion of the transfer roller during transfer.

BRIEF DESCRIPTION OF THE DRAWINGS

In the detailed description of the preferred embodiments of the invention presented below, reference is made to the accompanying drawings, in each of which the relative relationship of the various components are illustrated, it being understood that orientation of the apparatus may be modified.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
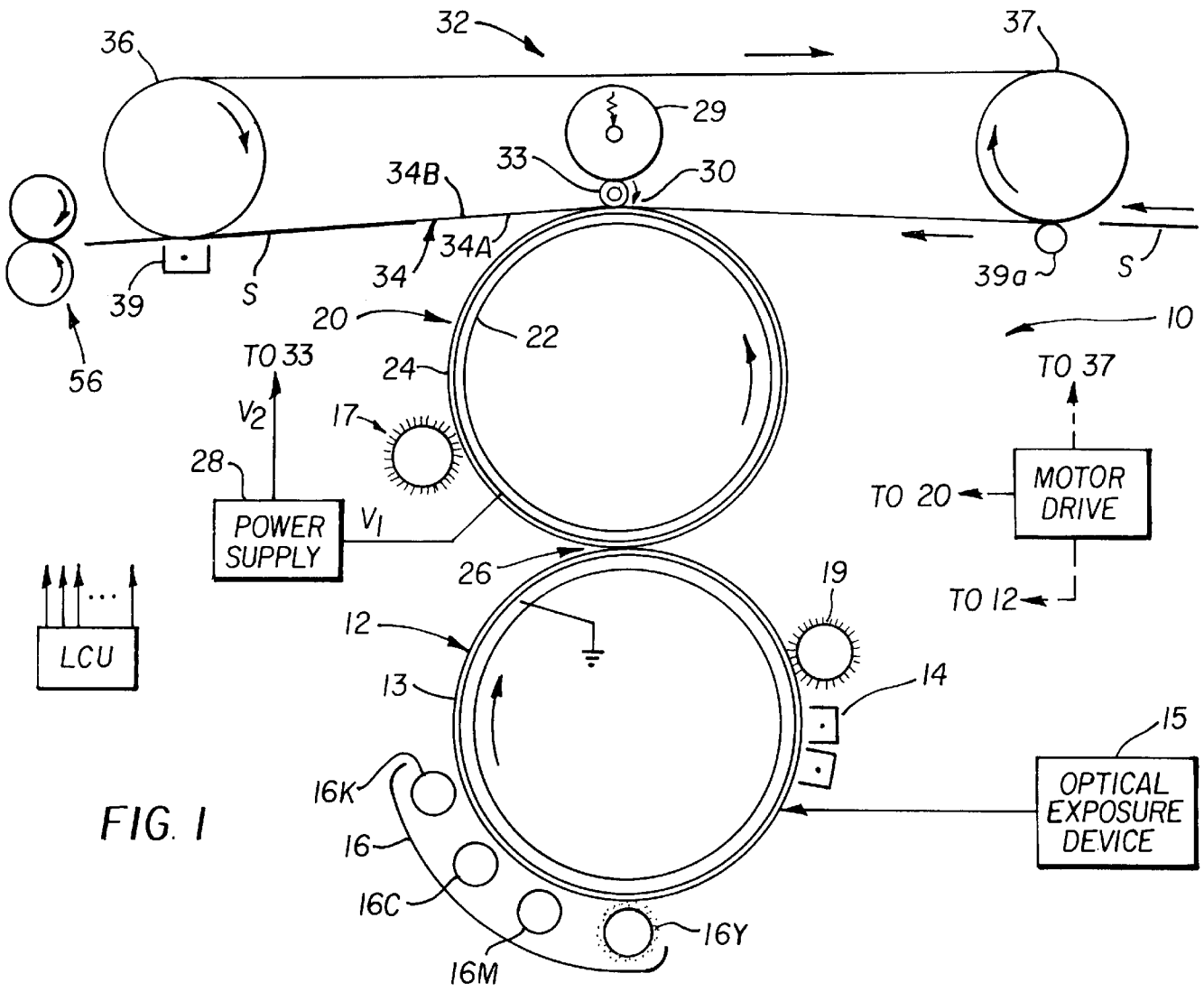
FIG. 1 is a generally schematic side elevational view of a first embodiment of a reproduction apparatus utilizing an intermediate image transfer member with an endless web mechanism for facilitating transfer of a marking particle image from the intermediate transfer member to a receiver member and having a transfer roller that is supported by a support roller for establishing a transfer nip with the ITM according to this invention, only basic components being shown for clarity of illustration.

Referring now to the accompanying drawings, FIG. 1 shows an exemplary image forming reproduction apparatus designated generally by the numeral 10. The reproduction apparatus 10 includes a primary image-forming member, for example a cylindrical drum 12 rotated by a suitable drive such as provided by a motor M or driven through frictional engagement with another driven member such as the ITM to be described. The intermediate transfer member used for the various embodiments described herein are described in more detail by Tombs et al, U.S. application Ser. No. 08/572,559 and more preferably in U.S. application Ser. No. 08/846,056, filed in the name of Vreeland et al and is preferably in the form of a roller, i.e., substantially cylindrical. The drum 12 has a photoconductive surface 13, upon which a pigmented marking particle image, or a series of different color marking particle images, is formed. The marking particles are preferably of dry insulative toner particles. In order to form images, the outer surface of drum 12 is uniformly electrostatically charged by a primary charger(s) such as a corona charging device 14 or other suitable charger such as roller chargers, brush chargers, etc. The uniformly charged surface is exposed by suitable exposure means, such as for example a laser or LED or other electro-optical exposure device 15 or even an optical exposure device to selectively alter the charge on the surface of the drum 12 to create a latent electrostatic image corresponding to an image to be reproduced. The electrostatic image is developed by application of pigmented marking particles to the image-bearing photoconductive drum 12 by a development or toning station 16. The development station 16 may include from one to four (or more) separate developing devices 16C, 16Y, 16M, 16K. When more than one developing device is provided as illustrated in FIG. 1, each device has particular different color marking particles associated respectively therewith. Each device is separately indexed into operative developing relation with drum 12 to apply different color marking particles respectively to a series of latent electrostatic images formed by the exposure device carried on drum 12 to create a series of different color marking particle images. Typically, the images are color separation images but are not limited to such images.

In the case of color separation images assume the separate developing devices include cyan developer device 16C, magenta developer device 16M, yellow developer device 16Y and black developer device 16K. The exposure device exposes a color separation image of the yellow record onto the uniformly electrostatically charged photoconductive surface 13. The electrostatically charged surface 13 is image-wise modulated by the exposure device 15 and developed with yellow toner or marking particles from the yellow developer device 16Y. The yellow marking particle image is transferred to the outer surface of a secondary or intermediate transfer member that is also rotating, for example, an intermediate transfer drum 20.

The intermediate transfer drum 20 includes a metallic conductive core 22 such as aluminum and a compliant blanket layer 24. The compliant layer 24 is formed of an elastomer such as polyurethane or other materials noted in the applicable literature which has been doped with sufficient conductive material (such as antistatic particles, ionic conducting materials, or electrically conducting dopants) to have a relatively low resistivity (for example, a bulk or volume electrical resistivity preferably in the range of approximately $10^7$ to $10^{11}$ ohm-cm). Further, the compliant layer is more than 1 mm thick, preferably between 2 mm and 15 mm, and has a Young's Modulus in the range of about 0.1 MPa to about 10 MPa, and more preferably between 1 MPa and 5 MPa. The bulk or volume electrical resistivity is preferably between $10^7$–$10^{11}$ ohm-cm. It is preferred to have a relatively thin hard outer skin or overcoat layer having a thickness of 2–30 microns or less and the electrical resistivity of which may be higher than that of the compliant layer. The Young's Modulus of the overcoat layer is preferably greater than 100 MPa. With such a relatively conductive intermediate transfer member drum 20, transfer of the single color marking particle images to the surface of drum 20 can be accomplished with a relatively narrow (in length) nip 26 and a relatively modest voltage potential of, for example, $V_1$=600 volts applied by potential source 28 to ITM drum 20 and applied at the conductive core 22. The voltage potential establishes an electrical field between the ITM and the photoconductive drum which includes a ground layer or stripe to electrostatically urge toner particles to transfer from the photoconductive drum 12 to the surface of the ITM drum 20. After transfer of the yellow marking particle image to the ITM the photoconductive surface 13 is cleaned by cleaning device such as cleaning brush 19 of any transferred marking particles and the surface is again electrostatically charged by charger 14 to a uniform primary charge suited for forming the next color separation image, for example cyan. The exposure device 15 then exposes the surface 13 to form a latent electrostatic color separation image of the magenta record which is developed with marking particles from the magenta developer device 16M. The magenta developed marking particle image is then transferred at nip 26 in registered relationship with the yellow toner image that is on the ITM 20. The process repeats for each of the additional color separation images so that a four-color composite marking particle image is formed on the ITM. Alternatively, only one or fewer than four composite color images may be formed on the ITM. The colors need not be those described above or the order of the colors may be other than that stated.

A single marking particle image, or as described above, a composite multicolor image comprising multiple marking particle images respectively formed in color registered relationship on the surface of the intermediate transfer member drum 20, is transferred in a single step to a receiver member S, which is fed into and then out from a nip 30 between rotating intermediate transfer member drum 20 and a transfer roller 33. The receiver member S is a sheet of paper, cardboard or plastic or a composite material and is fed from a suitable receiver member supply (not shown) into nip 30 where it receives the marking particle image. The receiver member exits the nip 30 and is transported by a transport mechanism (not shown) to a fuser 56 where the marking particle image is fixed to the receiver member by application of heat and/or pressure. Preferably, the transport mechanism will support the receiver member for entrance into the fuser so that receiver member is free of engagement with an endless web 34 support which will be described in more detail below. The endless web 34 and transfer roller 33 form a part of a transfer backing member 32. The receiver member with the fixed marking particle image is then transported to a remote location for operator retrieval. After transfer of the composite multicolor image to the receiver member S, the cleaning brush or other cleaning device 17, which was moved away from cleaning engagement with the outer surface of the ITM 20 or otherwise rendered inoperative in cleaning, is moved into engagement with or otherwise made operative to clean the outer surface of the ITM of toner particles and other particles that can be removed from the surface to prepare the surface for receipt of the next toner image.

Appropriate sensors (not shown) of any well known type, such as mechanical, electrical, or optical sensors for example, are utilized in the reproduction apparatus 10 to provide control signals for the apparatus. Such sensors may be located along the receiver member travel path between the receiver member supply through the nip 30 to the fuser 56. Further sensors are associated with the primary image-forming member photoconductive drum 12, the intermediate transfer member drum 20, the transfer roller 33, and various image processing stations. As such, the sensors detect the location of a receiver member in its travel path, and the position of the primary image-forming member photoconductive drum 12 in relation to the image-forming processing stations, and respectively produce appropriate signals indicative thereof. Such signals are fed as input information to a logic and control unit (LCU) including a microprocessor, for example. Based on such signals and a suitable program for the microprocessor, the LCU produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

As noted above, particular difficulties with the use of the intermediate transfer member are related to controlling the transfer field in the nip area between the intermediate member and the transfer backing member and in achieving reliable detack of a receiver member from the intermediate image transfer member. Further contributing to the difficulties is the fact that the receiver members utilized with the reproduction apparatus 10 can vary substantially. For example, they can be thin or thick paper stock or transparency stock. As the thickness and/or resistivity of the receiver member stock varies, the resulting change in impedance affects the electric field used in the nip 30 to urge transfer of the marking particles. Moreover, variations in relative humidity will vary the conductivity of a paper receiver member, which also causes it to affect the impedance of the transfer field. Therefore, to overcome these problems, the transfer backing member 32 according to this invention is an endless web arrangement.

In the embodiments described herein, an insulating endless web (IEW) wraps the ITM to provide a nip for the transfer of toner from the ITM to receiver member or receiver sheet (e.g. paper, transparency, etc. preferably in sheet form) which runs between the web and ITM. The electric field that urges toner from the ITM to the receiver member is supplied to the backside of the IEW by a roller charger positioned to define with the ITM the transfer nip. Pressure is applied in the transfer nip by the roller 33 so that the compliant ITM conforms to the surface irregularities of the receiver member and the toner image content on the ITM. The pressure reduces air gaps near the toner and therefore allows for higher electric fields and improved toner transfer efficiency. The receiver member is removed from contact with the IEW or detacks from the web downstream from the transfer area opposite an IEW support roller. Discussed in detail below, various chargers may also be employed at other locations on the web to affect paper handling, web conditioning and paper detack. In each case a fuser is located downstream of the last transfer station (if multiple ITMs are used) or the transfer station (if a single ITM is used) to fuse the toner image to the receiver member.

The endless web arrangement of the transfer backing member 32 includes the endless web 34 entrained for movement as shown by the arrows about a plurality of support members. For example, as shown in FIG. 1, the plurality of support members are rollers 36 and 37 (of course, other support members such as skis or bars would be suitable for use with this invention). The endless web 34 is preferably comprised of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web have a bulk resistivity of greater than about $1\times10^{12}$ ohm-cm. An endless web with the latter resistivity is considered herein an insulating endless web (IEW). The web material may be of any of a variety of flexible materials such as a fluorinated copolymer (for example, polyvinylidene fluoride), polycarbonate, polyurethane, polyethylene terephthalate, polyimides such as Kapton™, or silicone rubber. This bulk resistivity of the IEW is the resistivity of at least one layer of the IEW if the IEW is a multilayer article. Preferably, the top layer of the IEW which is in contact with the receiver member is the layer with the bulk resistivity of greater than about $1\times10^{12}$ ohm-cm. The above-described characteristics of the ITM and IEW are characteristic of the ITM and IEW in the various embodiments described herein. Whichever material that is used, such web material may contain an additive, such as an anti-stat (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed.

As shown, the endless web 34 is entrained about, and runs about electrically grounded support rollers 36 and 37 one of which is driven by the motor drive or other suitable drive. The support rollers are located such that the web exhibits a wrap angle about a portion of the intermediate transfer member drum 20. The total wrap of the insulating endless web 34 (IEW) may extend from 1 mm to about 20 mm around the ITM 20. The total wrap of the IEW around the ITM is larger than the nip length between the transfer roller 33 and the ITM 20 and is at least about 1 mm at the entrance side to the nip to reduce ionization between the receiver sheet and the ITM in the pre-nip region. The nip length is the length of the contact region between the transfer roller 33 and the back surface 34B of the IEW taken in the direction of movement of the receiver sheet S. The receiver member S attaches to the IEW 34 at roller 37, with the aid of a charging roller 39*a* or alternatively a corona charger which charges one surface of the receiver member S so that it is electrostatically held with its other surface in contact with the web. The grounded roller 37 supplies charge to the backside of the IEW 34. The nip 30 defines the area of the substantial portion of the transfer of marking particle images from the intermediate transfer member 20 to the receiver member S (e.g. paper, transparency, etc.) which is transported at the appropriate time, under the control of the logic and control unit (LCU) between the web surface 34A and the intermediate transfer member. The nip 30 is the space between the transfer roller 33 and the ITM 20. The transfer roller 33 is positioned behind the endless web 34 in engagement with surface 34B thereof and is spring biased by a spring of any suitable form to apply an applied force of about 0.3 lbs/in. to about 6 lbs/in wherein the force is expressed in per unit of linear length of the roller 33 (axial direction) to the web 34. The force establishes a narrow nip length where a substantial part of the transfer of the toner image to the receiver member or sheet occurs as the web surface 34A is pressed against the receiver sheet and the receiver sheet is pressed against the ITM 20.

The transfer roller 33 has an aluminum or other conductive metal core upon which is formed an outer blanket layer that has a high Young's Modulus of preferably greater than about 2 MPa; however, blankets of lesser hardness may also be suited. The transfer roller 33 is of a relatively small diameter when compared to the intermediate transfer member drum 20.

In the embodiment of the reproduction apparatus 10 shown in FIG. 1, according to this invention, one or more marking particle images are transferred to the receiver member S in nip 30, between the endless web 34 and the intermediate transfer member drum 20. Typically, the marking particle images will be a combined image of plural colors. Transfer roller 33 is electrically biased by potential source 28 or by a separate power supply providing preferably a constant transfer current of about 5$\mu$amps to about 100$\mu$amps to efficiently electrostatically urge transfer of marking particle images from the intermediate transfer member drum 20 to the receiver member S as the receiver member moves through the nip while supported upon surface 34A of the web 34. The receiver member S is detacked from the web 34 by detack corona charger 39 which emits charge to discharge the receiver member, for example, by applying charge that will neutralize the charge on one surface of the receiver member S, and, as noted above, is advanced to the fuser rollers 56 for fixing of the one or more colored toner images to the receiver members. Cleaner member(s) (not shown) may be provided for cleaning both sides of the IEW.

The inventors have found that substantial pressure in the nip at least about 5 psi from the transfer roller 33 improves the quality of the transferred image in the case where an ITM has a compliant layer. The pressure in the nip aids transfer by reducing the size of microscopic air gaps in the nip caused by paper roughness, particulate contamination and image structure. Furthermore, the transfer step is made more robust by making the web wrap of the transport web 34 on the ITM 20 larger than the nip length between the transfer roller and the ITM. The web wrap is not made too large to minimize unwanted movement between the print media and the transport web, which adversely affects image registration.

To summarize, the conditions for high quality and robust image transfer are (1) small web wraps; (2) web wraps larger than transfer roller/ITM nip lengths and (3) adequate pressure in the nip. The transfer configuration shown in FIG. 1 is designed to meet these requirements. To reduce the web wrap, the transfer roller 33 has a small diameter (10 mm as one example). The transfer roller comprises a solid metal core (6 mm diameter) and a resistive outer blanket layer (2 mm thick). The diameter of the ITM 20 in the example of FIG. 1 is about 180 mm. Furthermore, in accordance with the invention, in order to supply adequate pressure in the transfer nip without bending the transfer roller 33, a larger support roller 29 (1.5 inches diameter in this example) engages the transfer roller along the full axial extent of the transfer roller to limit distortion of the transfer roller 33. The engagement of the support roller 29 with the rolling surface of the transfer roller 33 is at a portion of the rolling surface of the transfer roller that does not form the nip, preferably 180° or directly opposite the nip. The support roller 29 may be spring-biased against the transfer roller 33. The amount of spring force is adjusted in accordance with the rigidity of the transfer roller which depends upon materials and dimensions. The relatively small diameter of the transfer roller 33 achieves a small nip length while maintaining adequate pressure in the transfer nip. The support roller 29 provides a more rigid structure that prevents the transfer roller 33 from bending and distorting the uniformity of the nip thickness dimension and nip pressure. This configuration improves the registration of color separations when transferring multiple images sequentially to a receiver member while maintaining excellent image quality and insensitivity to noise.

Figure 6:
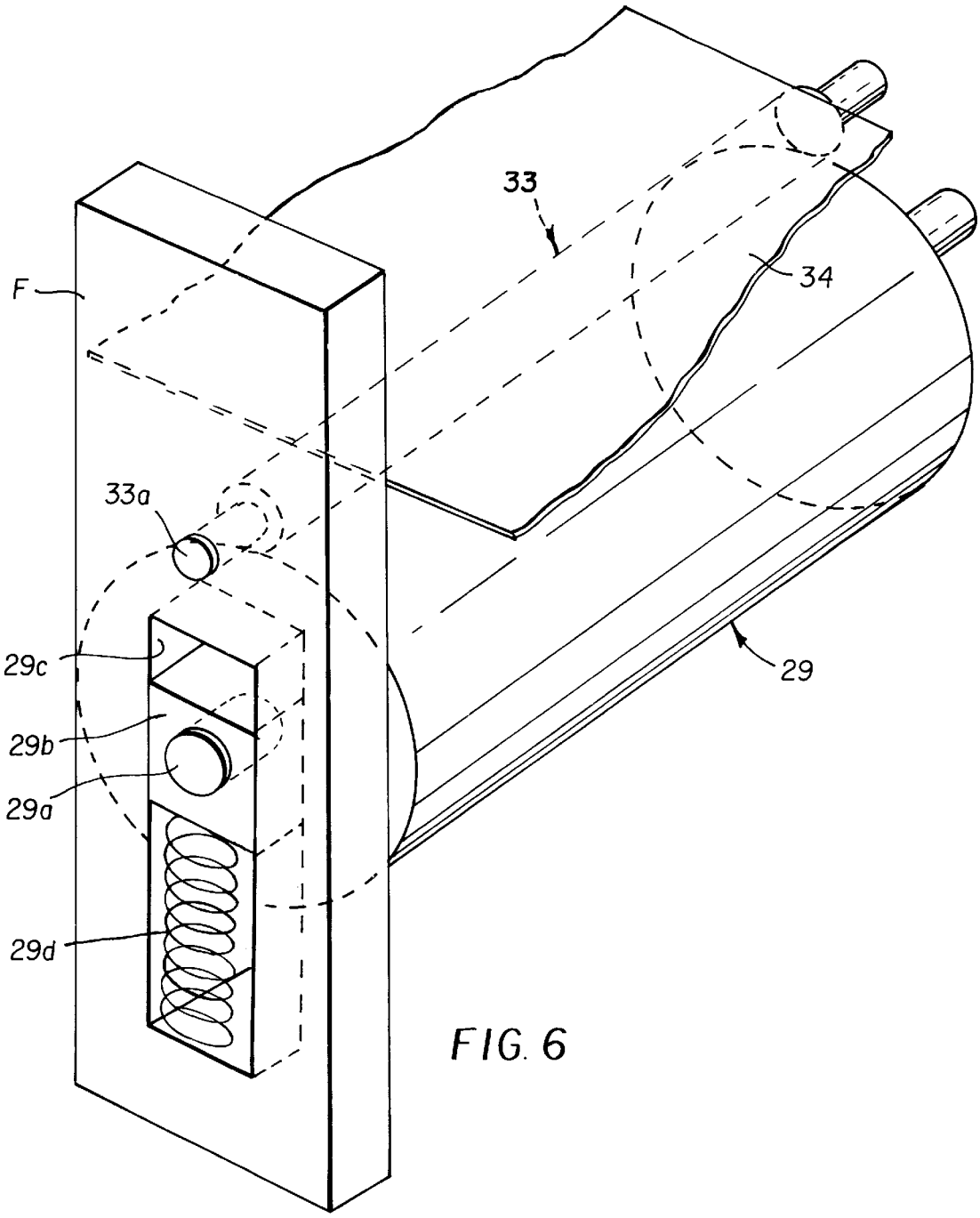
FIG. 6 is a perspective view illustrating a mounting of a support roller and a transfer roller in the embodiment of FIG. 1.

With reference now to FIG. 6, there is shown one example of a mounting structure for supporting the transfer roller 33 and the support roller 29 of FIG. 1 so that support roller remains in pressing engagement with the rolling surface of the transfer roller. The transfer roller has on each end thereof a shaft or axle 33*a* that is journaled or supported for rotation in a fixed bearing located in the machine frame F of the apparatus. The bearing locates the surface of the transfer roller at a predetermined position relative to the surface of the ITM to establish a nip spacing suitable for applying the appropriate transfer pressure to a receiver sheet when the receiver member and the transport web are in the nip 30. The support roller 29 has a shaft or axle 29*a* at each end thereof that is journaled or supported for rotation in a respective movable bearing block 29*b* that is slidable within a slot 29*c* formed in the machine frame or a plate mounted on the machine frame. Each bearing block is under a springload force by spring 29*d* to urge the surface of the support roller into pressure engagement with the surface of the transfer roller for the reasons described herein. The mounting structure shown in FIG. 6 may be used in any of the embodiments described herein. Other examples of mounting structure may be used including eliminating any spring structure and supporting both the transfer roller and support roller in fixed bearings wherein the respective spacings of the axles are selected to provide a pressure engagement between the two when a receiver member is in the nip 30.

In the referenced May et al application, there is disclosed a device for detecting thickness of a receiver sheet and positioning the transfer roller in a precise position relative to the ITM for establishing an appropriate nip spacing to accommodate receiver sheets of different thicknesses. The device of May et al may also be used herein and include a support roller for the transfer roller so that both move accordingly when receiver sheets of different thicknesses are provided.

As noted above, where a multiple color image is to be transferred to the receiver member, a multiple color image may be formed by overlaying in registered relationship separate color images to the outer layer 24 of the ITM. In such case, the web 34 and one cleaning device 17 for cleaning the ITM may be moved out of engagement with the ITM during formation of the multicolor image on the ITM and moved into engagement with the ITM prior to movement of the receiver member into the transfer nip. In lieu of combining alternate toner color images, different types of toner images may be combined such as an image developed with non-magnetic toner and an image developed with a magnetic toner or one or more color images and a clear toner layer. Also contemplated is creating a multicolor toner image on an image frame of a photoconductor using tri-level xerography or other known multicolor writing systems. The transfers described herein preferably employ electrostatic transfer at a temperature below the softening temperature of the toner particles.

Figure 2:
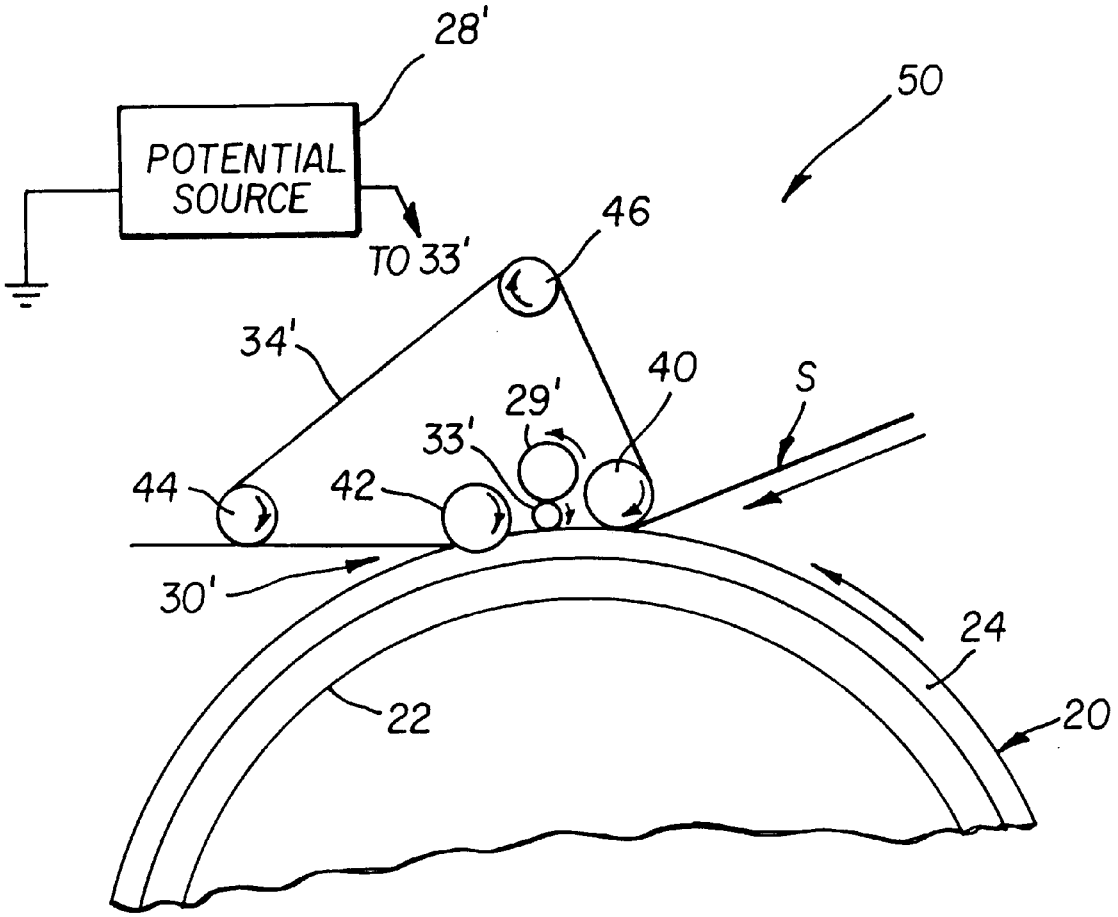
FIG. 2 is a side elevational view in schematic of a portion of a reproduction apparatus illustrating an alternate embodiment for an endless web transfer facilitating mechanism in accordance with the invention.

FIG. 2 shows an alternate embodiment of a reproduction apparatus 50 according to this invention. The difference of the alternate embodiment of FIG. 2 from that of the embodiment shown in FIG. 1 is the arrangement of the endless web 34'. In this alternate embodiment, the endless web 34' is trained about rollers 40, 42, 44 and 46. Rollers 40, 42 press against the back side of the web 34' to urge the web into intimate contact with the ITM 20 to define the transfer web wrap. Between rollers 40, 42 is the transfer roller 33' which also engages the backside of the web 34' to pressure the web into engagement with the ITM at a nip 30' wherein a substantial portion of the transfer occurs through the presence of an electrical field. The power supply 28' is connected to transfer roller 33' to establish the electrical field and preferably operates at a constant current so that a controlled amount of charge is supplied to the web. In this manner the transfer of marking particles is insensitive to variations in the resistivity of the receiver member which can vary by many orders of magnitude depending on the paper type, whether it was recently fused or not, and the ambient relative humidity. In this embodiment, support rollers 40 and 42 may also be electrically biased, to a desired potential. The support roller 29' engages the transfer roller 33' and is spring biased or otherwise positioned to reduce distortion of the transfer nip when a receiver sheet is located in the nip. In the embodiment of FIG. 2, the structure 20 may be alternatively a photoconductive drum or other primary imaging member upon which a toned image is created and then transferred to the receiver sheet S.

Figure 3:
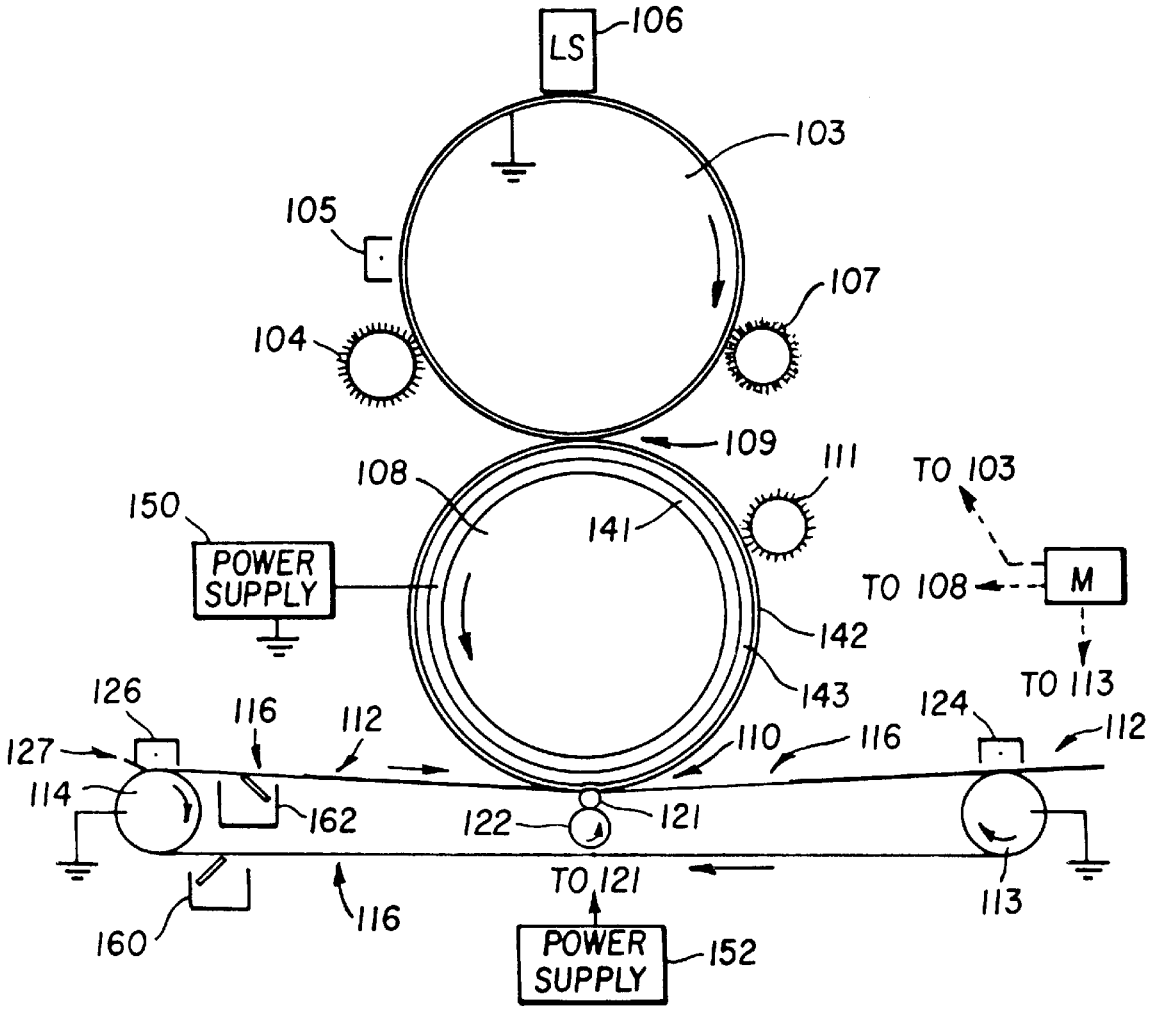
FIG. 3 is a side elevational view in schematic of a reproduction apparatus illustrating another alternate embodiment of the invention.

With reference to FIG. 3, a cylindrical photoconductive drum 103 is first cleaned by a cleaning station 104 then charged to a uniform potential with a corona charger 105 or other charger. The electrostatic latent image is written with an appropriate light source 106 after which the latent image is toned at toning station 107 with dry insulative toner particles (pigmented marking particles). The toned image is transferred from the photoconductor to the ITM 108 at nip 109. One or more images can be accumulated on the ITM in this manner. The characteristics of the ITM are similar to that described for the ITM of the apparatus of FIG. 1. The electrically conductive core 141 of the ITM is biased by power supply 150 to affect transfer of the toner image from the photoconductive drum 103 to the ITM 108 in nip 109 and from the ITM to the receiver member or receiver sheet such as paper or plastic transparency material 112 in nip 110. Nip 110 is a region smaller than the wrap of the IEW 116 around the ITM 108. The characteristics of the IEW are similar to that of the IEW described for the embodiment of FIG. 1. The total web wrap may extend from 1–20 mm. The IEW 116 is supported by ground rollers 113 and 114. The receiver member 112 attaches to the IEW 116 at roller 114 with the aid of corona charger 126 which charges one surface (top shown) of the receiver member so that it is electrostatically held with its other surface in contact with the web. The grounded roller 114 supplies charge to the back side of the IEW 116. An optional blade 127 on the charger 126 ensures good contact of the receiver sheet with the IEW. When the receiver sheet enters nip 110, the backside of the IEW 116 is charged in the nip 110 with charge from a transfer roller 121 to electrostatically urge transfer of toner from the ITM 108 to the receiver sheet 112. The characteristics of the transfer roller 121 are similar to that of the transfer roller described for the embodiment of FIG. 1. A power supply 152 supplies sufficient electrical voltage bias, preferably at constant current, to roller 121. The roller 121 also supplies substantial pressure in the nip to aid transfer by reducing the size of microscopic air gaps in the nip caused by paper roughness, particulate contamination and image structure. The total wrap of the IEW around the ITM is larger than the nip length. The wrap exceeds, by more than at least about 1 mm, the nip length formed by roller 121 and the ITM on at least the entrance side for receiving the receiver sheet, thereby reducing the amount of ionization in the pre-nip region that adversely affects transfer. Downstream of nip 110 the receiver member 112 detacks from the IEW 116 at roller 113 with the aid of corona charger 124 which discharges the receiver member; for example, by applying a charge that will neutralize the charge on the top surface of the receiver member 112. Subsequently the toner image transferred from the ITM to the receiver member in the nip 110 is fused to the receiver member by a fuser (not shown). Both sides of the IEW 116 can be cleaned by any appropriate cleaner such as blades 160 and 162. A motor M and suitable drive mechanisms are provided for driving the various members in the directions indicated by the respective arrows showing movement. It is known in electrophotographic engines to provide drive to one component such as a belt so that the belt can frictionally drive a drum. A cleaner 111 cleans the surface of the ITM. As in the embodiments of FIGS. 1 and 2 the transfer roller 121 is backed up by a spring biased or otherwise located support roller 122 which minimizes distortion in the transfer nip due to bending in the transfer roller.

Figure 4:
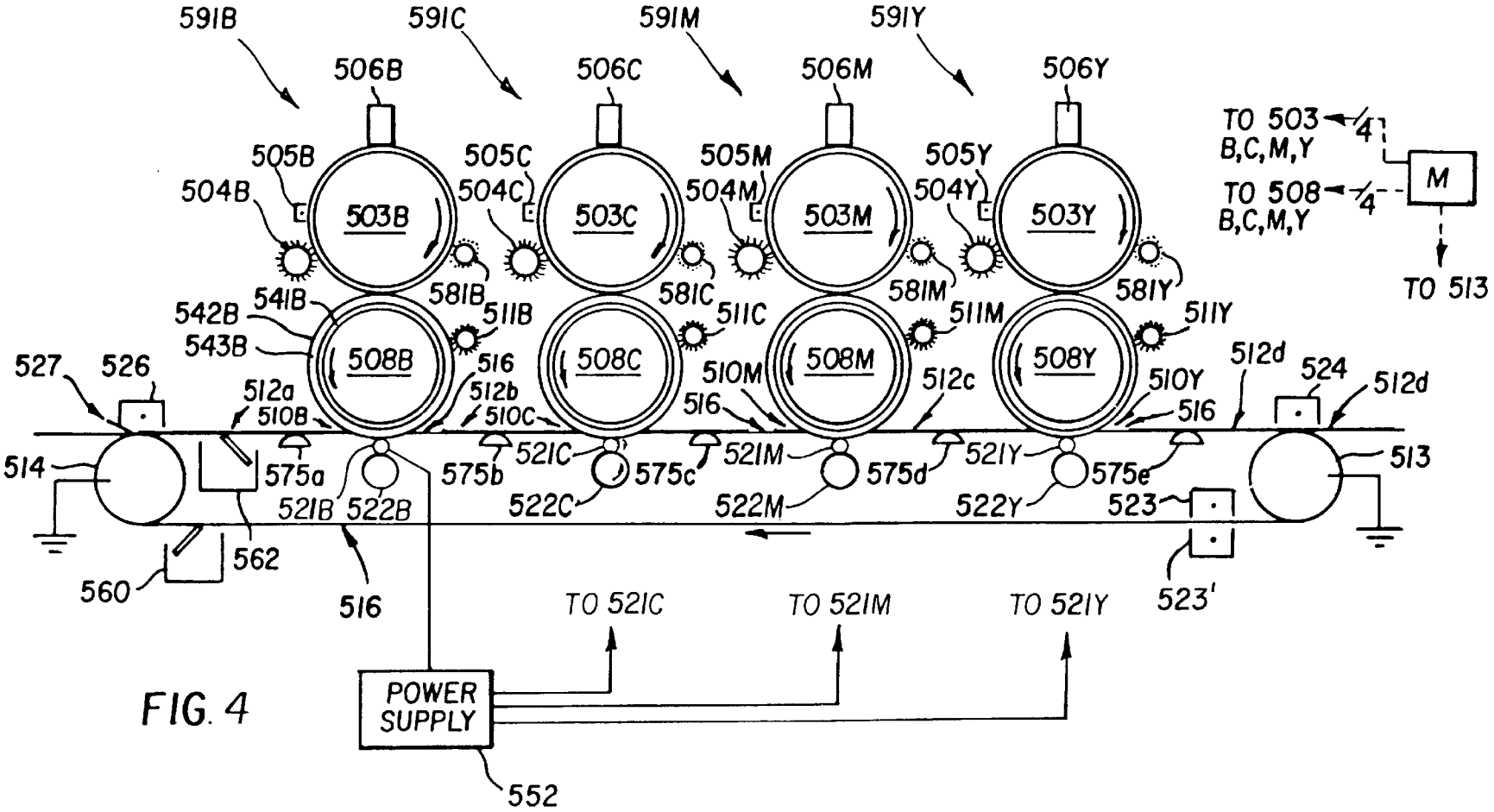
FIG. 4 is a side elevational view in schematic form of a reproduction apparatus and illustrating a fourth embodiment of the invention.

The apparatus shown in FIG. 4 like that of FIG. 1 is also a full color machine but the electrophotographic modules work in parallel and is preferred. Each electrophotographic module 591B, C, M, and Y produces a different color and all operate simultaneously to construct a four color image. In this embodiment the IEW 516 serially transports the receiver members 512*a*, 512*b*, 512*c* and 512*d* through nips 510 B, C, M and Y formed by the ITMs of each module where each color is transferred in turn to a respective receiver member so that each receiver member receives up to four superposed registered color images to be formed on one side thereof. Registration of the various stations application of color to the receiver member may be provided by various well known means such as by controlling timing of entry of the receiver in the nip in accordance with indicia printed on the receiver member or on the IEW transport belt wherein sensors sense the indicia and provide signals which are used to provide control of the various elements. Alternatively, control may be provided without use of indicia using a robust system for control of the speeds and/or position of the elements. While not shown, suitable controls can be provided using programmed computers and sensors including encoders which operate with same as is well known in this art.

In the embodiment of FIG. 4, each module, comprising a photoconductor drum and an ITM, is of similar construction to that shown in FIG. 3 except that as shown one IEW 516 operates with all the modules and the receiver member is transported by the IEW from module to module. The elements in FIG. 4 that are similar to that shown in FIG. 3 have 400 added to their reference numerals with a suffix of B, C, M and Y referring to the color module to black, cyan, magenta and yellow respectively to which it is associated. Four receiver members or sheets 512*a, b, c,* and *d* are shown receiving images from the different modules, it being understood as noted above that each receiver member may receive one color image from each module and that up to four color images can be received by each receiver member. The movement of the receiver member with the IEW is such that each color image transferred to the receiver member at the transfer nip of each module formed with the IEW is a transfer that is registered with the previous color transfer so that a four-color image formed in the receiver member has the colors in registered superposed relationship on the receiver member. The receiver members are then sent to a fusing station (not shown) as is the case for all the embodiments to fuse the dry toner images to the receiving member. The IEW is reconditioned by providing charge to both surfaces by opposed corona chargers 523, 523' which neutralize charge on the surfaces of the IEW.

In the embodiment of FIG. 4, a receiver member may be engaged at times in more than one image transfer nip and preferably is not in the fuser nip and an image nip simultaneously. The path of the receiver member for serially receiving in transfer the various different color images is generally straight, facilitating use with receiver members of different thickness. Support structures 575*a, b, c* and *d* are provided before entrance and after exit locations of each transfer nip to engage the IEW on the backside and alter the straight line path of the IEW to provide for wrap of the IEW about each respective ITM so that there is wrap of the IEW of greater than 1 mm on at least the pre-nip side. This wrap allows for reduced pre-nip ionization on the transfer side of the web 34, i.e., the side of the web 34 facing the toned image. The nip is where the transfer roller 521B, C, M and Y respectively contacts the backside of the web and where the electrical field is substantially applied but still a smaller region than the total wrap of the IEW about each ITM. The wrap of the IEW about each ITM also provides a path for the lead edge of the receiver member to follow the curvature of the ITM but the receiver member's lead edge separates from engagement with the ITM while moving along a line substantially tangential to the surface of the cylindrical ITM. Pressure of the transfer rollers 521 B, C, M and Y upon the backside of the IEW forces the surface of the respective compliant ITM to conform to the contour of the receiver member during transfer. Preferably, the pressure of the transfer rollers on the IEW is as described above for the embodiment of FIG. 1 and it is also preferred in the various embodiments described herein to have the support rollers 522 B, C, M and Y each have a layer in contact with the respective transfer roller, which layer's hardness is in the same range as the compliant layer of the ITM noted above. A respective support roller 522 B, C, M and Y engages a respective transfer roller 521 B, C, M and Y and is spring biased (or held at a fixed distance from the transfer roller) against the respective transfer roller to reduce distortion in the transfer nip when a receiver sheet is in the respective transfer nip.

An additional advantage to an embodiment such as that of FIG. 4 is that the development stations 581 B, C, M and Y may be, because of their relative locations where they develop their respective photoconductive drums, more suited for operation with preferred known development stations using so called "SPD development" described by Miskinis (IS&T's Sixth International Congress on Advances in Non-Impact Printing Technologies, pp. 101–110 published in 1990). In this process the developer in the respective development stations is comprised of relatively small "hard" magnetic carrier particles (approximately 30 $\mu$m in diameter, as opposed to over 100 $\mu$m in diameter for conventional two-component development systems) which form chains around the development roller in the development station. The term "hard" implies particles having a coercivity of at least 300 oersteds when magnetically saturated and exhibiting an induced magnetic moment of at least 20 EMU/gm of carrier when in an applied field of 1000 oersteds. It is preferred to have carrier having a much higher coercivity in the neighborhood of 2000 oersteds. In this method, developer made up of such hard magnetic carrier particles and oppositely charged insulative, dry toner particles is moved at the speed and direction of the image by high speed rotation of a magnetic core within a shell or sleeve on which the developer moves. It is preferred that the core be comprised of between 8 and 20 permanent magnets rotating between 300 and 1500 rpm. The shell speed is set so that the developer flow rate matches the velocity of the photoconductor. Rapid pole transitions on the sleeve cause the high coercivity carrier to experience a torque. "Strings" or "chains" of the carrier rapidly flip on the sleeve to move the developer on the shell in a direction opposite to that of the rotating core. In contrast, a low coercivity, "soft" magnetic carrier will internally magnetically re-orient in response to the pole transitions and not experience a torque adequate to cause carrier chains to flip. Because carrier particles, to which the toner particles are attached, tend to flip as the magnetic core turns, there is imparted kinetic energy to the toner particles.

In order to provide for a compact apparatus, it is desirable to minimize spacing between modules in the embodiment of FIG. 4. However, this configuration allows for an SPD development station to be positioned, with reasonable compactness of the apparatus, at a region on the photoconductive drum equivalent to between the 4 o'clock and 8 o'clock positions of the respective photoconductive drum as illustrated in FIG. 4 wherein the development stations are shown respectively at about the 4 o'clock positions of the respective photoconductive drum.

Figure 5:
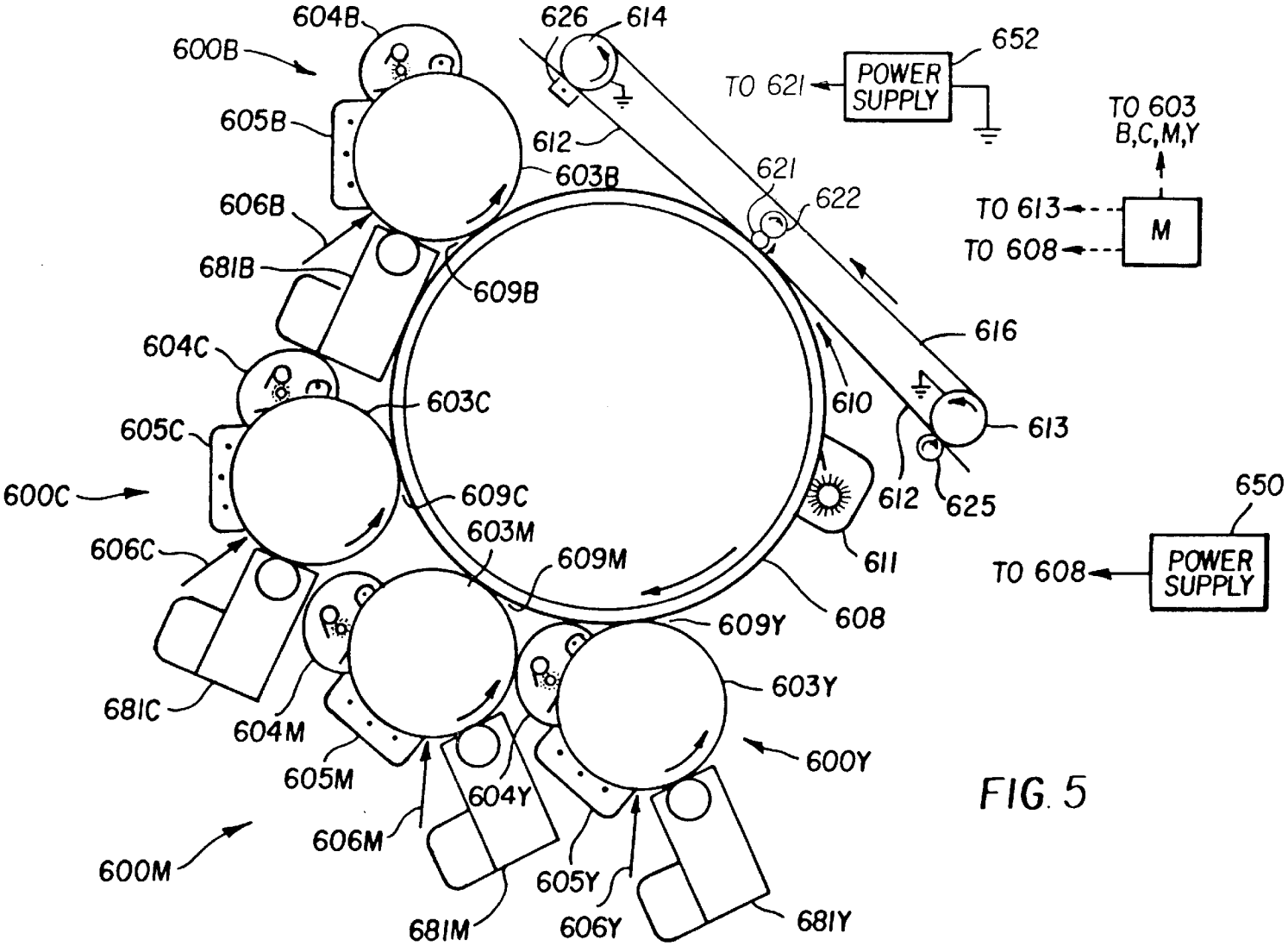
FIG. 5 is a side elevational view in schematic form of a reproduction apparatus and illustrating a fifth embodiment of the invention.

In FIG. 5, still another alternate embodiment is illustrated. In this embodiment, a full four-color electrophotographic apparatus or machine is illustrated. The apparatus includes an ITM 608 having the characteristics of the ITMs described above; i.e., it is in the form of a rotating cylindrical roller or drum and is comprised of an electrically conducting aluminum core, a relatively thick (1–20 mm) compliant blanket layer formed over the core and a relatively thin (2 $\mu$m–30 $\mu$m) hard overcoat layer over the compliant layer. The characteristics of the various layers of the ITM (thickness, hardness and resistivity) are identical to the characteristics of the ITMs described above. An IEW 616 is also provided as shown and also has the characteristics of the IEW for the embodiment of FIG. 4. Tension in the IEW is provided by support rollers 613, 614 about which the belt is entrained. The tension in the IEW, as in the other embodiments, may be provided by springs or other locating elements operating on the support rollers 613, 614 so as to establish a tension in the IEW so that where the IEW 616 engages the ITM 608 there is, as in the other embodiments, a partial wrapping of the IEW about the ITM in the nip area 610. Additional pressure is provided by electrically biased transfer roller 621 which engages the backside of the IEW at the nip area 610 and pressingly urges the IEW into intimate engagement with the ITM so that wrapping of the IEW about the ITM is preferably more than the actual transfer nip area. A power supply 652 provides preferably a constant current and electrical voltage bias to the transfer roller 621 to transfer a multicolor toner image to a receiver member 612 supported on the IEW and moved into the nip 610. The ITM 608 is also electrically biased by a power supply 650 which provides at nip 610, in cooperation with the electrical voltage bias on roller 621, an electrical field suited for transfer of the multicolor toner image to the receiver member 612 in the nip 610. Drive to the various components, in particular the IEW 616, ITM 608, photoconductive drums 603 B, C, M and Y, and various cleaning and development stations may be provided by a motor (M) and suitable drive members as is well known. A receiver member 612 is fed from a suitable supply of sheets to the transfer station. It is moved into engagement with the IEW 616 and electrostatically charged by charger 626 which applies charge to one surface of the receiver member as shown to cause the opposite surface to be electrostatically held in contact with the IEW. The receiver member then is transported by the IEW into the nip 610 for transfer of the multicolor image into the receiver member 612. In order to minimize distortion in the nip 610 when the receiver member is within the nip a support roller 622 is provided in engagement with the transfer roller 620 and the support roller 622 is spring biased or a fixed spacing from the transfer roller 620 to press against the transfer roller to minimize bending in the transfer roller along its length. After transfer of the toner image to the receiver member 612, the receiver member is conveyed by the IEW 616 into the nip between support roller 613 and a detack roller 625. An electrical bias is provided on detack roller 625 by a suitable power supply to neutralize charge on the receiver member so that the receiver member can be fed or transported into a fuser station (not shown) which may include a pair of fusing rollers, one of which is heated for fixing or fusing of the multicolor toner image to the receiver member. The receiver member is then, as in the other embodiments, conveyed to a location, such as a tray, external to the machine for storing completed copy sheets. Provision may also be made for returning the receiver member so that the opposite side thereof may receive an image to create a duplex copy as is well known.

In order to form the multicolor toner image on the ITM, there are provided four primary image-forming modules 600 B, C, M and Y for forming color separation images in black, cyan, magenta and yellow, respectively. The four modules are essentially identical and a description of the components forming one of the modules is applicable to the others. However, it is known because of differences in properties between the different color toners to use different development station biases and other charging parameters and/or transfer biases. It is also known to have the black development station be larger since black toner is typically used in greater amounts than the other color toners.

The first primary image-forming module 600Y includes a rotating drum type photoconductor 603Y that includes a photoconductive layer on or near the surface thereof. A belt or web-type photoconductor may also be used. A primary charger 605Y establishes a uniform electrostatic charge on the surface of the photoconductor 603Y. An imaging source indicated by arrow 606Y exposes the surface to modulate the electrostatic charge with color separation information to form a latent image to be developed with yellow toner. As noted above, the imaging source may be a laser, LED or other electro-optic, magneto-optic, liquid crystal, digital micrometer device or other spatial light modulator devices or the exposure may be an optical exposure. The latent image is developed with yellow toner at toning station 606Y and this developed toner image is electrostatically transferred to the outer surface of the rotating ITM 608 at transfer nip 609Y. Transfer of the toner to the ITM is provided by an electrical field between the photoconductive drum and the ITM. Untransferred toner is removed from the surface of the photoconductor 603Y at a cleaning station 604Y.

After the yellow toner image is transferred to the ITM, the ITM continues to rotate and the developed magenta toner separation color image formed on photoconductive drum 603M is transferred to the ITM in register with the yellow toner separation image. Similarly, the cyan and black developed toner separation images are transferred to the ITM in register with the previously applied yellow and magenta toner images to form the four color or multicolor image.

After transfer of the multicolor image formed on the ITM to the receiver member 612 the ITM is cleaned at a cleaning station 611 to prepare the ITM for receipt of the next toner image.

In the various color embodiments described, the apparatus may also be used to form single color images or color images in various combinations of color in addition to the four-color image described.

In some of the described embodiments, the wrap of the belt that supports the receiver member in contact with the ITM is defined by the locations of the web entrainment rollers such as rollers 36, 37 in FIG. 1 or locations of skids 575*a–e*. The actual transfer nip where the major portion of the electrical field exists between the ITM and the roller or other counter electrode for transfer of the toner image to the receiver member is smaller than this wrap. Thus, by providing a greater amount of wrap length than the length of the actual transfer nip there is reduced the likelihood of pre-nip transfer and pre-nip ionization particularly where the transfer belt or IEW is substantially insulative. As noted above, it is preferred to have the wrap be 1 mm or greater beyond the roller nip in at least the pre-nip area. A transfer roller is used to apply the pressure to the underside of the belt to urge the receiver member into intimate contact with the ITM at the nip. It is preferred that the blanket layer of the transfer roller (33, 33', 121, 521B–Y, 621) be of intermediate conductivity, i.e. resistivity of $10^7$–$10^{11}$ ohm-cm, however, rollers that are highly conductive; i.e., having conductivity of a metal, also may be used. A support roller 622 engages the transfer roller to reduce bending of the transfer roller when a receiver sheet is in the nip as described for the other embodiments.

In the embodiments described above, transfer of the image to the ITM and from the ITM to the receiver member is made electrostatically and preferably without addition of heat that would cause the toner to soften. Thus, no fusing occurs upon transfer of the toner image to the receiver member in the nip between the IEW or transfer support belt and the ITM. In the forming of plural color images in registration on a receiver sheet, the invention contemplates that plural color toner images may be formed on the same image frame of the photoconductive image member using well known techniques; see, for example Gundlach, U.S. Pat. No. 4,078,929. The primary imaging member may form images by using photoconductive elements as described or dielectric elements using electrographic recording. The toners used for development are preferably dry toners that are preferably nonmagnetic and the development stations are known as two-component development stations. Single component developers may be used but as noted, are not preferred. While not preferred, liquid toners may also be used.

Other charging means such as rollers or brushes may be used instead of the corona wire chargers used for electrostatically holding the receiver member or print media to the web and for electrically discharging the receiver member, however, rollers are not preferred for discharging the receiver member after a toner is applied thereto.

In the color embodiments described herein, it is preferred to use dry, insulative toner particles having a mean volume weighted diameter of between about 2 $\mu$m and about 9 $\mu$m. The mean volume weighted diameter measured by conventional diameter measuring devices such as Coulter Multisizer, sold by Coulter, Inc. Mean volume weighted diameter is the sum of the mass of each particle times the diameter of a spherical particle of equal mass and density, divided by total particle mass.

Although description of the various embodiments is with an intermediate transfer member, the invention concerning a transfer roller and backup support roller may be used without an intermediate transfer member wherein the transfer roller presses against an IEW in a nip formed between the transfer roller and a primary image-forming member such as a photoconductive drum or belt. The primary image-forming member and intermediate transfer member are thus broadly an image-bearing member or an image-supporting member.

The reproduction apparatus including the mechanism for facilitating transfer of a marking particle image from an intermediate transfer member or a primary image-forming member to a receiver member, according to this invention, is not limited to the particular geometry of the endless web arrangement of the transfer backing member as shown in the figures. A person skilled in the art would be able to realize the benefits of this invention with many different configurations.

The invention has been described in detail with particular reference to certain preferred embodiments thereof, but it will be understood that variations and modifications can be effected within the spirit and scope of the invention.

What is claimed is:

1. An electrostatographic reproduction apparatus comprising:

an image-bearing member that supports a marking particle image;

a moving web having a first surface supported in nip relation with said image-bearing member for supporting a receiver member in a nip between the web and the image-bearing member; and a transfer roller having a rolling surface that is in pressure engagement with a second surface of the web located relative to the image-bearing member to press the web and form the nip with the image-bearing member; and a support roller that engages the transfer roller along a portion of the rolling surface while the transfer roller is operating to press the web in nip relation to the image-bearing member for rigidifying the transfer roller from distorting to improve uniformity of the nip.

2. The reproduction apparatus of claim 1 wherein said image-bearing member is an intermediate transfer member (ITM) and the apparatus includes a primary image-forming member operatively associated with the ITM for transfer of the marking particle image to the image-bearing member.

3. The reproduction apparatus according to claim 2 and including a source of electrical potential connected to the transfer roller to electrically bias the transfer roller for electrostatic transfer of the marking particle image to a receiver member in the nip.

4. The reproduction apparatus according to claim 3 wherein said web is an endless web and has a bulk resistivity greater than $1\times10^5$ ohm-cm.

5. The reproduction apparatus of claim 3 wherein said intermediate transfer member includes a compliant layer having a Young's Modulus in the range of between 0.1 MPa and 10 MPa and said web has a bulk resistivity greater than $1\times10^{12}$ ohm-cm.

6. The reproduction apparatus of claim 5 wherein said intermediate transfer member is in the form of a drum.

7. The reproduction apparatus of claim 3 wherein said intermediate transfer member is in the form of a drum.

8. The reproduction apparatus according to claim 2 wherein said web is an endless web and has a bulk resistivity greater than $1\times10^5$ ohm-cm.

9. The reproduction apparatus of claim 2 wherein said web is an endless web and has a bulk resistivity greater than $1\times10^{12}$ ohm-cm.

10. The reproduction apparatus of claim 2 wherein plural intermediate transfer members (ITMs) are in nip relationship with the web and plural respective transfer rollers each associated with a respective one of the ITMs forms a respective nip with the respective one of the ITMs, and a respective support roller engages a respective transfer roller along a portion of a respective rolling surface of the respective transfer roller for rigidifying the respective transfer roller from distorting.

11. The reproduction apparatus of claim 1 wherein the image-bearing member is cylindrical and the web is partially wrapped about the image-bearing member at a location at least 1 mm from the entrance to the nip.

12. The reproduction apparatus of claim 1 including plural image-bearing members and wherein the web is partially wrapped about each image-bearing member so that there is contact of the web with each image-bearing member at a location at least 1 mm from the entrance to the nip and wherein each image-bearing member is a roller and a plurality of transfer rollers with each transfer roller being associated with a respective image-bearing member to form a respective nip, each transfer roller having a diameter that is substantially smaller in size than the diameter of the image-bearing member.

13. A reproduction method comprising:

forming a marking particle image on an image-supporting member;

moving a web that supports a receiver member to advance the receiver member into a nip defined between the image-supporting member and a transfer roller and the web is in the nip so that the receiver member is between the web and the image-supporting member;

establishing an electrical transfer field in the nip for electrostatically transferring the marking particle image to the receiver member brought into intimate contact with the image-supporting member in said nip; and pressing a member against a portion of a roller surface of the transfer roller that does not form the nip to reduce bending of a portion of the rolling surface of the transfer roller that is associated with the nip.

14. The reproduction method according to claim 13 wherein said endless web has a bulk resistivity greater than $1\times10^{5}$ ohm-cm.

15. The reproduction method according to claim 13 wherein said endless web has a bulk resistivity greater than $1\times10^{12}$ ohm-cm.

16. The reproduction method of claim 13 wherein the image-supporting member is an intermediate transfer member (ITM) and in the step of forming a marking particle image, a marking particle image is formed on a primary image-forming member and transferred to the ITM.

17. The reproduction method according to claim 16 wherein said intermediate transfer member has a compliant layer with a Young's Modulus in the range between 1 MPa and 5 MPa.

18. The reproduction method according to claim 13 and supporting the web to provide wrap of the web about the intermediate transfer member that extends beyond the nip.

19. The reproduction method according to claim 13 and including serially transferring plural different marking particle images of respective plural different colors to said intermediate transfer member in superposed registration on said intermediate transfer member to form a multicolor image on the intermediate image transfer member.

20. The reproduction method of claim 13 wherein in the step of pressing a member, the member being pressed against the roller surface is a roller.

21. A reproduction method comprising:

forming a marking particle image on each of a plural number of primary image-bearing members, images on the plural number of members being in different respective colors;

advancing a receiver member on one endless web serially into respective nips defined between the plural number of image-bearing members and a respective transfer roller associated with each image-bearing member;

establishing electrical transfer fields in the nips with application of pressure by each transfer roller that press the web at the respective nip for serially electrostatically transferring in superposed registration the marking particle images to the receiver member serially brought into intimate contact with the image-bearing members in the nips; and applying pressure to each of the transfer rollers along a portion of a rolling surface of each transfer roller that is not associated with the nip to reduce bending of the transfer rollers.

22. The method of claim 21 wherein each image-bearing member is cylindrical and the endless web is partially wrapped about each image-bearing member so that there is contact of the web with each image-bearing member at a location at least 1 mm from the entrance to the nip; and wherein each transfer roller has a diameter that is substantially smaller in size than the diameter of each respective image-bearing member.

* * * * *